US010301751B2

(12) United States Patent
Dias et al.

(10) Patent No.: US 10,301,751 B2
(45) Date of Patent: May 28, 2019

(54) ELECTRONICALLY FUNCTIONAL YARNS

(71) Applicant: NOTTINGHAM TRENT UNIVERSITY, Nottingham Nottinghamshire (GB)

(72) Inventors: Tilak Kithsiri Dias, Nottingham (GB); Anura Rathnayake, Nottingham (GB)

(73) Assignee: Nottingham Trent University, Nottingham (GB)

( * ) Notice: Subject to any disclaimer, the term of this patent is extended or adjusted under 35 U.S.C. 154(b) by 255 days.

(21) Appl. No.: 15/509,375

(22) PCT Filed: Sep. 4, 2015

(86) PCT No.: PCT/GB2015/052553

§ 371 (c)(1),
(2) Date: Mar. 7, 2017

(87) PCT Pub. No.: WO2016/038342

PCT Pub. Date: Mar. 17, 2016

(65) Prior Publication Data

US 2017/0275789 A1 Sep. 28, 2017

(30) Foreign Application Priority Data

Sep. 8, 2014 (GB) ..... 1415837.2

(51) Int. Cl.
*D02G 3/36* (2006.01)
*D02G 3/02* (2006.01)
(Continued)

(52) U.S. Cl.
CPC ..... *D02G 3/36* (2013.01); *D02G 3/02* (2013.01); *D02G 3/22* (2013.01); *D02G 3/441* (2013.01); *D10B 2401/18* (2013.01)

(58) Field of Classification Search
CPC ..... D02G 3/02; D02G 3/04; D02G 3/045; D02G 3/06; D02G 3/12; D02G 3/22;
(Continued)

(56) References Cited

U.S. PATENT DOCUMENTS 5,318,845 A * 6/1994 Tanaka ..... D01F 1/09 428/372
6,437,422 B1 * 8/2002 Solomon ..... D02G 3/441 257/40
(Continued)

FOREIGN PATENT DOCUMENTS

GB 2472026 1/2011
JP 2001064870 A * 3/2001
(Continued)

OTHER PUBLICATIONS

Search Report issued by the UKIPO in respect of UK Patent Application No. 1415837.2 from which this application claims priority dated Jan. 21, 2015.
(Continued)

*Primary Examiner* — Ismael Izaguirre
(74) *Attorney, Agent, or Firm* — Dewitt LLP; Thomas J. Nikolai

(57) ABSTRACT

An electronically functional yarn comprises a plurality of carrier fibers (6) forming a core with a series of electronic devices (2) mounted on the core with conductive interconnects (8) extending along the core. A plurality of packing fibers (10) are disposed around the core, the devices and the interconnects, and a retaining sleeve (12) is disposed around the packing fibers. The core, the devices and the interconnects are confined within the plurality of packing fibers retained in the sleeve. In the manufacture of the yarn the electronic devices with interconnects coupled thereto in sequence are mounted on the core; the carrier fibers with the mounted devices and interconnects are fed centrally through
(Continued)

a channel with packing fibers around the sides thereof to form a fiber assembly around the core, which is fed into a sleeve forming unit in which a sleeve is formed around the assembly to form the composite yarn.

26 Claims, 3 Drawing Sheets

(51) Int. Cl.
*D02G 3/22* (2006.01)
*D02G 3/44* (2006.01)

(58) Field of Classification Search
CPC ..... D02G 3/36; D02G 3/362; D02G 3/38; D02G 3/40; D02G 3/44; D02G 3/441; D10B 2401/18
See application file for complete search history.

(56) References Cited

U.S. PATENT DOCUMENTS 7,592,276 B2 * 9/2009 Hill ..... D02G 3/441 313/511
8,155,497 B2 * 4/2012 Shtein ..... B82Y 10/00 385/101
8,860,012 B2 * 10/2014 Park ..... H01L 51/5287 257/40
2009/0139198 A1 * 6/2009 Dias ..... D02G 3/404 57/210
2010/0325770 A1 * 12/2010 Chung ..... D02G 3/12 2/69
2013/0092742 A1 4/2013 Brun et al.

FOREIGN PATENT DOCUMENTS

JP 201389718 9/2013
WO WO 02/084617 A1 * 10/2002
WO WO 2008/080245 A2 * 7/2008

OTHER PUBLICATIONS

The International Search Report issued during the International phase of the PCT application, dated Jun. 22, 2017.

* cited by examiner

ELECTRONICALLY FUNCTIONAL YARNS

CROSS-REFERENCED TO RELATED APPLICATIONS

This application claims priority from Application PCT/GB2015/052553, filed Sep. 4, 2015, which is deemed incorporated by reference in its entirety in this application.

STATEMENT REGARDING FEDERALLY SPONSORED RESEARCH OR DEVELOPMENT

Not applicable.

BACKGROUND OF THE INVENTION

I. Field of the Invention

This invention relates to yarns incorporating electronic devices and their manufacture. It relates particularly to such yarns in which the devices and electrical connections thereto are protected. Also part of the invention is a method of manufacturing the yarns for incorporation into fabric products for example, although other uses are contemplated.

II. Discussion of the Prior Art

International Patent Publication No. WO2006/123133, the contents whereof are hereby incorporated by reference, discloses a multi-filament yarn including an operative devices confined between the yarn filaments, and a method for its manufacture. The yarn filaments are typically polyester or polyamide. One or more of the yarn filaments can be electrically conductive and coupled to the device to form an electrical connection thereto. These filaments can be metal filament wires in the form of a polymeric monofilament yarn with either a copper or silver metal core wire. The device may take one of various forms, such as a silicon chip, a ferro-magnetic polymeric chip or a phase change chip.

Reference is also directed to Japanese Patent specification No. 2013189718A and US Patent publication No. 2013/092742, the disclosures whereof are hereby incorporated. Both describe yarns carrying electronic devices within a protective outer layer or sheath.

Yarns of the above International Publication are effective and can be used in fabric products. However, where the device has an electrical connection the connection will be exposed on the yarn surface and thereby compromised by contact with other yarns or elements, or by external conditions. The Japanese and US references go some way towards addressing this issue, but do not provide a resolution.

SUMMARY OF THE INVENTION

A primary aim of the present invention is to avoid risk of such exposure and thereby enhance the efficiency of a device in a series of devices installed in a yarn. Another aim is to incorporate devices and connections thereto in a yarn in such a manner that they are unobtrusive. According to the invention an electronically functional yarn comprises a plurality of carrier fibres forming a core; a series of electronic devices mounted on the core with conductive interconnects extending along the core; a plurality of packing fibres around the core, the devices and the interconnects; and a retaining sleeve around the packing fibres, wherein the core, the devices and the interconnects are confined within the plurality of packing fibres retained in the sleeve. The interconnects can comprise at least one conductor that extends the length of the yarn. By mounting the devices and interconnects on carrier fibres they are more easily retained in the body of the yarn and within the packing fibres. The packing fibres can be untwisted; i.e. extend generally parallel to the yarn axis, but may be selectively bunched or twisted to fill spaces between the devices. A separate filler material may also be used for this purpose. These options can serve to preserve a substantially uniform cross-section along the length of the yarn and between the devices. The packing fibres, and a filler material if used, may be selected to either encourage or discourage the absorption of moisture by the composite yarn. In preferred embodiments the carrier fibres include at least some which are arranged in a planar array and the electronic devices may all be mounted on one side of the array. The devices can then be easily mounted on at least two of the carrier fibres, but mounting on one can be sufficient in many applications. This means that different devices can be mounted on different ones or groups of the carrier fibres.

The electronic devices incorporated in yarns of the invention can take many forms, including operative devices such as a silicon chip signaling devices such as light, sound or symbol generators, micro-controllers and energy harvesting devices. Particularly suitable for use in yarns of the present invention are ultra thin electronic dice.

The packing fibres in yarns of the invention can be independent from one another; i.e. relatively movable, but at least some may be bonded to secure the integrity of the yarn, particularly around a device. Such a bond can be an adhesive bond, or established by heating the relevant zone. Some independence is preferred to allow the fibres relative movement when the yarn is bent or twisted. This assists in maintaining a high degree of uniformity in the overall yarn diameter. The packing fibres can be natural fibres, man-made fibres or synthetic fibres such as polyester or polyamide, and typically have diameters in the range 10-15 μm.

The carrier fibres for the devices can be of the same material as the packing fibres, but the material will normally have a high melting point, typically above 350° C., and have a high level of thermal and chemical stability. The reason for this is to ensure they can withstand the heat generated when interconnects are coupled to the electronic devices. Semiconductor chips with solder pads for the interconnects are normally first mounted on the carrier fibres and the interconnects, for example fine copper wire, can be coupled to the pads by using a reflow soldering technique. This technique involves depositing a small quantity of solder paste on the solder pads and then applying heat to melt the paste and then create a strong metallic bond. The carrier fibres forming the yarn core must hold the devices as this process is completed, and will normally have diameters in the range 10-100 μm. Polybenzimidazole or aramid based fibres such as PBI, Vectran or Normex are examples of some which can be used as carrier fibres. Typically the core will consist of or include four carrier fibres will extend side by side providing a platform for the devices to which they are attached, although the devices will not necessarily be attached to or mounted on all the fibres forming the platform. The devices themselves are normally enclosed in a polymeric micro-pod which also encloses the adjacent length of carrier fibres to establish the attachment, normally with the solder pads on the device and the interconnects. The devices and the carrier fibres can also be hermetically sealed between two ultra thin polymeric films. The interconnects, typically fine copper wire of around 150 μm diameter, normally extend on and/or between the carrier fibres.

The retaining sleeve can take many different forms, and may vary depending upon the form taken by the packing fibres and to some extent, the intended use of the yarn. It will normally be a fibre structure comprising one or more of natural, man-made and synthetic fibres. Typical sleeves are interlaced fibre structures, but interlooped knitted fibre structures can also be used. Its function is to preserve the arrangement of the packing fibres around the devices, carrier fibres and interconnects. It can take the form of a separate yarn helically wound around the packing fibres, a woven or knitted fabric structure, or a woven or knitted braid. A fibre or yarn structure is though preferred to most easily accommodate bends and twists.

The invention is also directed at a method of manufacturing a yarn incorporating electronic devices. The method comprises mounting electronic devices with interconnects coupled thereto in sequence on a core consisting of a plurality of carrier fibres; feeding the carrier fibres with the mounted devices and interconnects centrally through a channel with packing fibres around the sides thereof to form a fibre assembly around the core; feeding the fibre assembly into a sleeve forming unit in which a sleeve is formed around the assembly to form a composite yarn; and withdrawing the composite yarn from the sleeve forming unit. The channel through which the core with the mounted devices is fed can be formed centrally in a carrousel having separate openings around its periphery through which sleeve fibres are fed for forming the sleeve. This arrangement is particularly suitable when the sleeve is to be braided as braiding fibres can be fed through the carrousel directly into a braiding unit forming the sleeve around the packing fibre assembly. However, as described below, the sleeve fibres can be warp or weft fibres feeding into a circular warp or weft knitting head. The yarn may be withdrawn from the sleeve forming unit with the packing fibre assembly being effectively drawn in a pultrusion process at a rate determined by the speed at which the sleeve forming unit operates. If any filler material is to be used this may be added at the entrance to the channel. Any bunching or twisting to fill the spaces between the devices with packing fibres can be effected between the channel and the sleeve forming unit.

DESCRIPTION OF THE DRAWINGS

The invention will now be described by way of example and with reference to the accompanying schematic drawings wherein.

DETAILED DESCRIPTION

Figure 1:
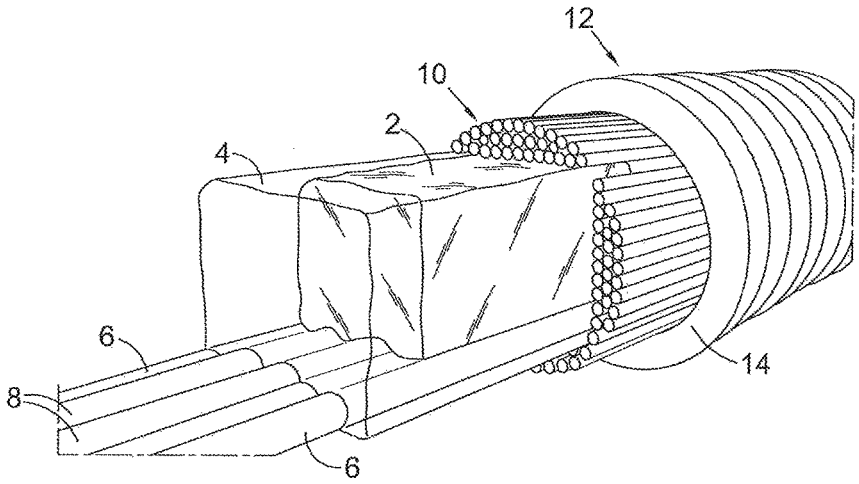
FIG. 1 shows a broken perspective view of a yarn according to a first embodiment of the invention.

In the yarn shown in FIG. 1 a semiconductor chip 2 is sealed in a polymeric micro-pod 4 which extends around four 100 μm PBI carrier fibres 6. The chip shown is 900 μm long and has a square cross section of 500×500 μm. Two 150 μm copper filament interconnects 8 extend from the chip 2 within the pod 4 over the carrier fibres 6. Polyester packing fibres 10 (diameter 10 μm) extend around the pod 4, the carrier fibres 6, and the interconnects 8. As shown they extend substantially parallel to the yarn axis, but may be bunched or twisted to fill the spaces between the pods 4. A filler (not shown) may also be used for this purpose. Some twisting of the packing fibres around the pods 4 can also be of value to provide a protective layer, but this will depend upon the shape of the pod. The linear arrangement of packing fibres shown can be more appropriate when the pod 4 is rectanguloid or cylindrical in shape. Whatever arrangement is selected some of the packing fibres 10 can be bonded together by adhesive or heating to provide an hermetic seal around the pod. An hermetic seal can also be established by sandwiching the devices, their interconnects and the carrier fibres between two normally ultra-thin polymeric films. Bonding of at least some of the outer packing fibres is avoided, thereby allowing relative movement to accommodate bending or twisting of the yarn with minimum affect on the uniformity of the yarn as a whole.

A sleeve 12 surrounds the packing fibres 10 to stabilize the fibre assembly with the pods 4 and interconnects 8 held centrally therein, and particularly to provide additional protection of the interconnects from exposure and mechanical stress during use. Thus, fabrics including yarns according to the invention can survive washing and tumble drying for example, in addition to normal wear and tear during use, with less risk of compromise to the interconnects and the functionality of the chips or other devices installed in the yarn. The sleeve shown comprises a separate textile yarn 14 helically wound around the packing fibres 10. Alternative forms of sleeve are woven or knitted braids. A wide variety of fibres can be used for the sleeve, as noted above, which is normally a textile structure with fibres of diameter in the range 10-50 μm.

Figures 2, 6:
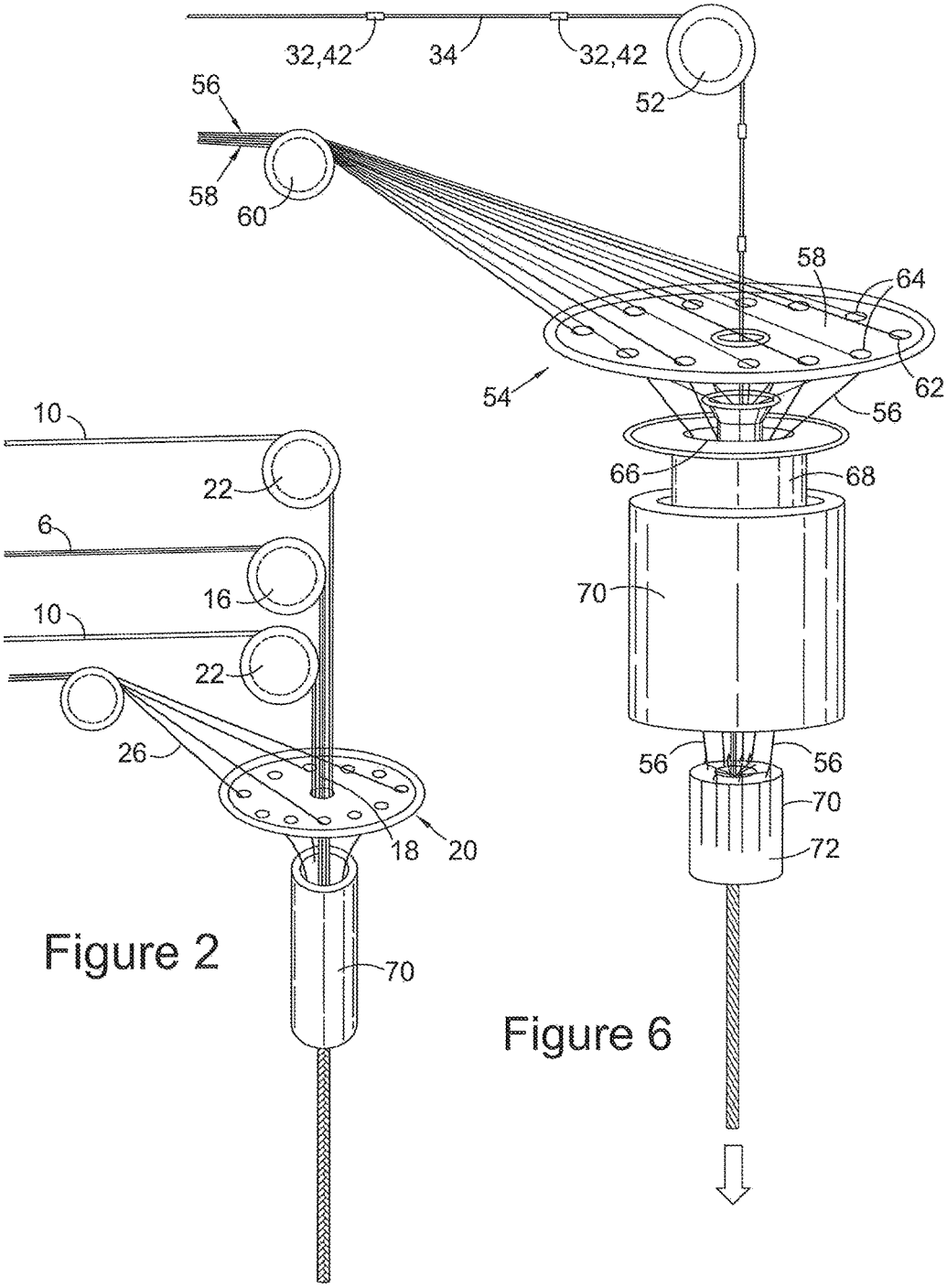
FIG. 2 shows the sequence of stages in the manufacture of a yarn according to the invention.
FIG. 6 shows the sequence of stages in an alternative procedure in the manufacture of a yarn according to the invention.

A process for manufacturing a yarn of the invention is illustrated in FIG. 2. Carrier fibres 6 populated with electronic devices (pods 4 not shown in FIG. 2) such as semiconductor chips are delivered round a guide pulley 16 to a central channel 18 in a disc 20. Packing fibres 10 are delivered round guide pulleys 22 also to the channel 18 on opposite sides of the carrier fibres 6. More than two delivery paths for the packing fibres 10 can be made if desired if a more dense or diverse layer of fibres is required around the carrier fibres 6 in the manufactured yarn. If a filler is to be inserted between the pods (4) this can be injected at this stage. Any adhesive or heat treatment of the packing fibres 10 is also applied at this stage.

The assembly comprising the carrier (6) and packing (10) fibres passes from the channel 18 to a sleeve unit 24. In the process shown in FIG. 2 the sleeve comprises separate textile yarns 26 delivered through openings in the periphery of the disc 20 which are knitted, woven or braided in the sleeve unit 24. Any twisting or bunching of the packing fibres 10 is carried out as the assembly passes from the channel 18 to the sleeve unit 24. The completed yarn emerges from the sleeve unit as shown, normally by being drawn at an appropriate rate.

Figure 3:
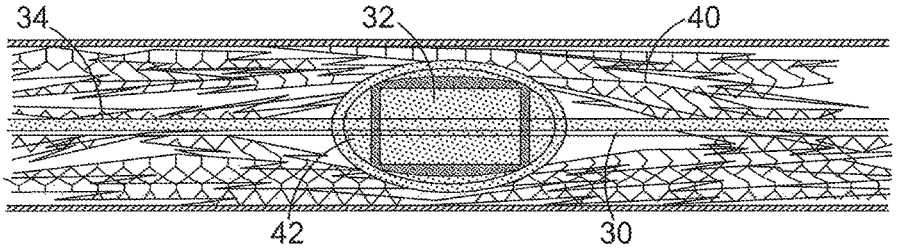
FIG. 3 is a longitudinal sectional view of a yarn according to a second embodiment of the invention.
Figure 4:
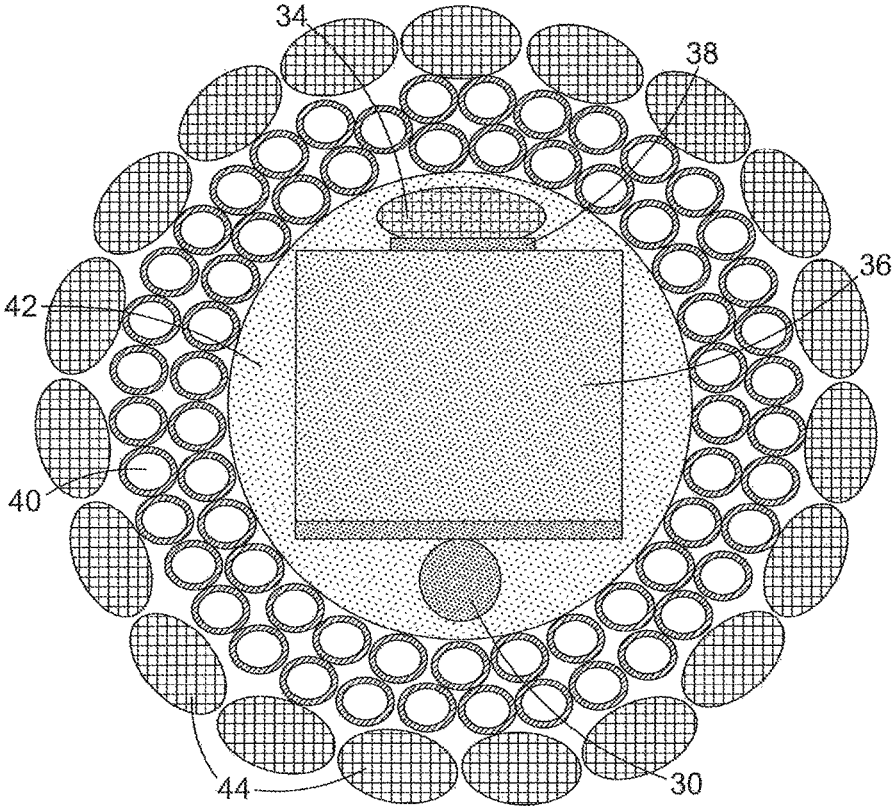
FIG. 4 is a lateral cross sectional view of the yarn of FIG. 3.

FIGS. 3 and 4 illustrate a second embodiment of the invention in which the interconnects 30 extend over the electronic devices 32 on the opposite side from the core 34 comprising the carrier fibres, and into the core from either side of each device. Each device is typically a semiconductor packaged die 36 attached to the core 34 by a layer 38 of adhesive on one side with copper interconnects 30 soldered thereto on the other side. The device 36 and the attached sections of the core 34 and the interconnects 30 are enclosed in a polymeric resin micro-pod 42. Alternatively or additionally, the devices, interconnect and carrier fibres can be hermetically sealed between two ultra-thin polymeric films. The packing fibres 40 that are shown in a relatively regular formation in FIG. 4, are mobile and can be twisted and/or bunched as shown in FIG. 3 around and between the micro-pods to preserve a substantially uniform cross section for the completed composite yarn. A filler can also be used for this purpose if required. A textile sleeve comprising fibres 44 surrounds the packing fibres.

Figure 5:
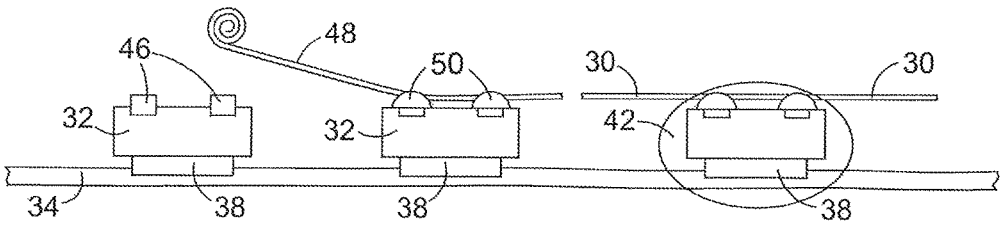
FIG. 5 illustrates a procedure for mounting electronic devices and conductive interconnects on carrier fibres in the manufacture of a yarn according to the invention.

FIG. 5 illustrates how each electronic 32 devices may be mounted on the core 34 in a yarn of the kind shown in FIGS. 3 and 4. A layer 38 of adhesive is applied to one or more carrier fibres in the core 34; the device 32 bearing solder pads 46 is mounted on the adhesive layer 38, and the adhesive bond is cured by ultraviolet spot curing. Copper wire 48 is laid on the solder pads 46; solder paste 50 is applied and the joints are secured by infra-red reflow soldering. The copper wire is then cut as required to create individual interconnects, or left if it is to bypass one or more adjacent devices. The device and attached sections of the wire 48 and core 34 are then enclosed in a resin set by ultraviolet spot curing to form the micro-pod 42.

The manufacturing process shown in FIG. 6 illustrates particularly an alternative technique for installing the packing fibres and creating the sleeve. The core 34 carrying the devices 32 in their micro-pods 42 and interconnects, is fed centrally around a first guide roller 52 to a central opening in a disc 54. Sleeve fibres 56 and packing fibres 58 are fed from respective second and third guide rollers 60 to alternate openings 62 and 64 around the periphery of the disc 54. From the disc 54 the packing fibres 58 are fed to a central duct 66 which also receives the core 34 carrying the devices and micro-pods. The sleeve fibres 56 pass through a stationary yarn guide tube 68, and then though a rotatable cylindrical yarn guide 70 to a needle cylinder 72 where the fibres are interlooped to form the sleeve. The completed composite yarn is drawn from the needle cylinder 72 at a rate commensurate with the knitting process. The same materials as are referred to above can be used for the carrier fibres; the packing fibres, and the sleeve fibres, in the process of FIG. 6

The central duct 66 has a shaped conical opening for receiving the packing fibres, to ensure they are arranged around the core 34 and its micropods and interconnects. The duct 66 extends the full length of the yarn guide tube 68 and rotatable cylindrical yarn guide 70 to retain the packing fibres within the sleeve fibres as they are positioned to be knitted into the sleeve in the needle cylinder 72. Thus, in the completed yarn, the packing fibres within the sleeve surround and enclose the carrier fibres, micropods and interconnects ensuring that the interconnects extend along the core. The process illustrated would use a warp knitting process in which the cylindrical yarn guide 70 oscillates to properly orient the sleeve fibres prior to knitting. The process can be adapted for weft knitting, but the orientation of the fibres around the duct 64 prior to knitting is more complex.

The invention claimed is:

1. An electronically functional yarn having a yarn axis and comprising a plurality of carrier fibres forming a core; a series of electronic devices mounted on the core with conductive interconnects extending along the core; a plurality of packing fibres around the core, the electronic devices and the conductive interconnects; which packing fibres extend generally parallel to the yarn axis to preserve a substantially uniform cross-section along the length of the yarn and between the devices; and a retaining sleeve around the packing fibres, wherein the core, the electronic devices and the conductive interconnects are confined within the plurality of packing fibres retained in the sleeve.

2. An electronically functional yarn according to claim 1 wherein the carrier fibres are arranged in a substantially planar array.

3. An electronically functional yarn according to claim 1 wherein each of the electronic devices is mounted on at least two carrier fibres.

4. An electronically functional yarn according to claim 1 wherein the packing fibres are independent from one another.

5. An electronically functional yarn according to claim 1 wherein at least some of the packing fibres are bonded together.

6. An electronically functional yarn according to claim 1 wherein at least one of the conductive interconnects comprise at least one conductor extending the length of the yarn.

7. An electronically functional yarn according to claim 1 wherein the packing fibres fill spaces between the electronic devices.

8. An electronically functional yarn according to claim 1 including a filler material located in spaces between the electronic devices and the packing fibres.

9. An electronically functional yarn according to claim 1 wherein the retaining sleeve is a fibre structure.

10. An electronically functional yarn according to claim 1 wherein the retaining sleeve comprises a supplementary yarn helically wound around the packing fibres.

11. An electronically functional yarn according to claim 1 wherein the retaining sleeve comprises an interlaced fibre structure.

12. An electronically functional yarn according to claim 1 wherein the retaining sleeve comprises an interlooped knitted fibre structure.

13. A method of manufacturing a composite yarn incorporating electronic devices comprising:

forming a first subassembly by mounting electronic devices with interconnects coupled thereto in sequence on a core consisting of a plurality of carrier fibres;

forming a fiber assembly around the core by feeding the first subassembly through a channel having a channel axis, and positioning packing fibres so the packing fibres extend generally parallel to the channel axis around the sides thereof, the packing fibres preserving a substantially uniform cross-section along the length of the fibre assembly;

feeding the first subassembly and fibre assembly together into a sleeve forming unit in which a sleeve is formed around the fiber assembly to form a composite yarn; and withdrawing the composite yarn from the sleeve forming unit.

14. A method according to claim 13 wherein the channel is formed centrally in a disc having a periphery and peripheral openings around the periphery of the disk; and wherein sleeve fibres are fed through the peripheral openings to the sleeve forming unit in which they are processed to form the sleeve.

15. A method according to claim 13 wherein the channel extends into the sleeve forming unit.

16. A method according to claim 13 wherein the carrier fibres are arranged in a substantially planar array.

17. A method according to claim 13 wherein each of the electronic devices is mounted on at least two carrier fibres.

18. A method according to claim 13 wherein the sleeve forming unit comprises a braiding head.

19. A method according to claim 13 wherein the sleeve forming unit comprises a circular weft knitting head.

20. A method according to claim 13 wherein the sleeve forming unit comprises a circular warp knitting head.

21. A method according to claim 13 wherein the packing fibres are bunched or twisted between the electronic devices as the fibre assembly passes from the channel to the sleeve forming unit.

22. A method according to claim 13 wherein a filler is injected into the fibre assembly between the electronic devices as the fibre assembly passes from the channel to the sleeve forming unit.

23. A functional yarn according to claim 1 wherein the packing fibres are selectively arranged to fill spaces between the electronic devices.

24. An electronically functional yarn having a yarn axis and comprising a plurality of carrier fibres forming a core; a series of electronic devices each mounted on at least two of said carrier fibres with conductive interconnects extending along the core; a plurality of packing fibres extending around the core, the electronic devices and the interconnects, said packing fibres extend generally parallel to the yarn axis and selectively arranged to preserve a substantially uniform cross-section along the length of the yarn and between the electronic devices; and a retaining sleeve around the packing fibres, wherein the core, the electronic devices and the conductive interconnects are confined within the plurality of packing fibres retained in the sleeve.

25. An electronically functional yarn according to claim 24 including a filler material in the spaces between the electronic devices within the packing fibres.

26. An electronically functional yarn according to claim 24 wherein the carrier fibres are arranged in a substantially planar array.

* * * * *